US010729928B2

(12) United States Patent
Wilhelm et al.

(10) Patent No.: US 10,729,928 B2
(45) Date of Patent: Aug. 4, 2020

(54) SHORT DUMBBELL

(71) Applicants: Andreas Wilhelm, Sinsheim (DE); Valerij Missal, Sinsheim (DE)

(72) Inventors: Andreas Wilhelm, Sinsheim (DE); Valerij Missal, Sinsheim (DE)

(73) Assignee: Andreas Wilhelm, Sinsheim (DE)

( * ) Notice: Subject to any disclaimer, the term of this patent is extended or adjusted under 35 U.S.C. 154(b) by 0 days.

(21) Appl. No.: 16/076,321

(22) PCT Filed: Jan. 12, 2017

(86) PCT No.: PCT/DE2017/200001

§ 371 (c)(1),
(2) Date: Aug. 7, 2018

(87) PCT Pub. No.: WO2017/137045

PCT Pub. Date: Aug. 17, 2017

(65) Prior Publication Data

US 2019/0038927 A1 Feb. 7, 2019

(30) Foreign Application Priority Data

Feb. 8, 2016 (DE) ..... 10 2016 201 858

(51) Int. Cl.

| | |
|---|---|
| ***A63B 21/072*** | (2006.01) |
| *A63B 71/06* | (2006.01) |
| *G09F 23/00* | (2006.01) |

(52) U.S. Cl.

CPC ..... *A63B 21/0728* (2013.01); *A63B 21/0726* (2013.01); *A63B 2071/0694* (2013.01); *G09F 23/00* (2013.01)

(58) Field of Classification Search

CPC ..... Y10T 428/24017; Y10T 428/218; A63B 21/0726; A63B 21/0728; G09F 23/00

See application file for complete search history.

(56) References Cited

U.S. PATENT DOCUMENTS

| | | | |
|---|---|---|---|
| 5,078,392 | A | 1/1992 | Kracht |
| 2004/0162197 | A1 | 8/2004 | Towley et al. |
| 2014/0239701 | A1 | 8/2014 | Velez |

FOREIGN PATENT DOCUMENTS

| | | | |
|---|---|---|---|
| AT | 384399 | B | 11/1987 |
| EP | 1867365 | A1 | 12/2007 |

OTHER PUBLICATIONS

International Search Report for PCT/DE2017/200001 dated Sep. 5, 2017.

*Primary Examiner* — Alexander S Thomas

(74) *Attorney, Agent, or Firm* — McDonnell Boehnen Hulbert & Berghoff LLP

(57) ABSTRACT

Disclosed is a dumbbell comprising a dumbbell bar (1) that is used as a handle (3), and weight plates (2) at the ends that can be plugged or clipped onto the dumbbell bar (1) and can be replaced with different weights; the weight plate (2) has an outer surface (5) that faces outward in the mounted state. The disclosed dumbbell is characterized in that the outer surface (5) is formed by an asymmetrically weight-loaded flywheel (6) which is mounted on the weight plate (2) so as to be parallel thereto and be able to rotate about a central axis in such a way that the flywheel (6) always has the same orientation or angular position.

10 Claims, 3 Drawing Sheets

SHORT DUMBBELL

This application is a U.S. National Phase Application pursuant to 35 U.S.C. § 371 of International Application No. PCT/DE2017/200001 filed Jan. 12, 2017, which claims priority to German Application Serial No. 10 2016 201 858.2, filed Feb. 8, 2016. The entire disclosure contents of these applications are herewith incorporated by reference into the present application.

The present invention relates to a dumbbell with a dumbbell bar functioning as a handle, and weight plates at the ends that can be placed or slid onto the dumbbell bar, and which can be replaced with different weights, wherein the weight plates have an outer surface that faces outward when placed on the bar.

A dumbbell is a piece of athletic equipment, normally comprising a bar and two weights attached to the ends in the form of spheres or disks. Training with such equipment is referred to as dumbbell training. Light dumbbells are used in gymnastics and for fitness training, while dumbbells with heavy weights are used for martial arts and bodybuilding. Dumbbells are used in so-called CrossFit training, in order to give people training for various fitness disciplines a more balanced workout.

Exercising with dumbbells improves muscle development, as well as increasing impact and jumping strength. These devices have become increasingly more popular, in particular to ensure balanced muscle development and training.

Dumbbells of different types are known. These normally comprise a dumbbell bar and weights at the ends, in particular weight plates. These weight plates can normally be exchanged, such that the weight of any barbell, in particular a dumbbell, can be varied. Thus, two dumbbell bars are sufficient for exercising with both arms, which are provide with an assortment of exchangeable weight plates, such that different weights can be assembled, depending on the fitness of the athlete. It may also be possible to place multiple weight plates on each end of the bar.

The weight plates on the bars are labeled with the weight of the entire dumbbell in the case of fixed weight plates, such that the weight thereof can be read from the side. With exchangeable weight plates, these are also labeled with the weight of the plate such that they can likewise be read from the side so that the athlete can make a selection. These dumbbells are normally stored on the floor or in a special rack. Depending on the angle at which the dumbbells are stored, the labeling on the side of the weight plate can be read if placed in the proper orientation, or it is at an angle or upside-down. This makes it not only difficult to read, thus complicating selection of the desired dumbbell, but it also has a negative impact on the appearance of a single dumbbell or numerous dumbbells, and conflicts with the desire to present an orderly and aesthetically pleasing appearance.

Furthermore, the dumbbells known in practice are often labeled with company logos, the name of the manufacturer and/or that of the respective fitness center. The same applies here as well regarding the statements above with respect to the weight markings, wherein, with labels or logos, the visual appearance is disrupted when the weight plates are not aligned precisely.

The fundamental object of the present invention is therefore to design and develop a dumbbell of the generic type, and weight plates for dumbbells, such that when the dumbbell is placed on the ground or in a rack without paying attention to its orientation, the labeling on the side of the weight plates can always be read easily, such that the visual appearance in particular of one or numerous dumbbells is always orderly, without having to expend extra effort to arrange them in an orderly manner.

The above object is achieved by the features of the coordinate independent claims 1 and 10. The dumbbell according to the invention is characterized according to claim 1 such that the outer surface is formed by an asymmetrically weighted flywheel, which is mounted on the weight plate, parallel thereto, such that it can rotate (in the manner of a pendulum) about a central axis, such that it always assumes the same orientation or angular position.

It has been realized in accordance with the invention that it is possible to have a labeling on the side of the weight plate that is always in the correct position in that the outer surface of the weight plate is formed by an asymmetrically weighted flywheel, which aligns itself automatically in the manner of a pendulum in an angular position dictated by the weight, specifically due to gravity. The weighted flywheel is mounted on the weight plate such that it can rotate about a central axis, parallel to the weight plate, such that it always assumes the same orientation or angular position. If such a dumbbell is rolled on a surface, the angular position of the weight plate changes thereby, but not that of the flywheel. This flywheel always remains in the correct alignment due to the asymmetrical weighting and its bearing, or it swings back into the vertical/horizontal alignment when shifted slightly.

It should be noted at this point that the weighted flywheel has no negative effects on exercising with such a dumbbell, specifically in that the flywheel and the movement thereof, as well as the weight necessary for aligning the flywheel, are not noticeable. This weight is minimal with respect to the overall weight of the dumbbell equipped with the at least two weight plates, and therefore negligible. A sense of imbalance due to rotating flywheels is never noticed.

It should be noted at this point that the flywheels can be mounted in any number of ways. The important thing is that they are supported such that they can rotate about a central axis, e.g. via a more or less frictionless ball bearing. Various concrete configurations/designs are conceivable, wherein the important thing is that the flywheel is supported with very little friction.

In an advantageous manner, the weight plates have a circumferential rim, extending orthogonally away from the weight plate, which extends at least partially beyond or above the flywheel to a slight extent. This means that the rotating or rotatable flywheel is located in a region within the weight plate, and is able to rotate in a protected manner accordingly. The risk of damage to the flywheel is thus effectively prevented in this regard.

In concrete terms, the rim of the weight plate can be an integral component of the weight plate. It is likewise conceivable that this rim is made of a softer material, e.g. plastic or rubber. The rim can thus be applied to the actual weight plate through injection molding technologies. Various designs of the rim that protects the weight plate are conceivable.

In particular, it is also advantageous from an aesthetic perspective when the flywheel is flush with the rim of the weight plate, such that when the dumbbell is stationary, or put down, it cannot be seen that the flywheel is a supplementary moving part of the dumbbell. The dumbbell still has a compact, monolithic appearance, even though the flywheel requires a certain amount of engineering effort with respect to its capacity for rotation.

The surface of the flywheel, and thus the outer surface of the weight plate, functions as an information medium, or a flat label can be applied to it. This information can be applied directly to the outer surface of the flywheel, e.g. printed, embossed, molded, etc. thereon. The important thing is that this information can comprise text and/or image labeling.

It is also conceivable to glue a supplementary information medium onto the surface of the flywheel. It is likewise conceivable to attach the information carrier to the flywheel with Velcro or some other attachment means. All means of attachment are conceivable. When attaching the information medium thereto, it is important to align it with the weighted (automatic) alignment of the flywheel.

The information medium can contain the weight of the weight plate or the dumbbell as specific information. It is also conceivable for further additional information to be included thereon, e.g. advertising by the manufacturer of the weight plates, the owner of the respective fitness center, or advertising for a third party that can be purchased. Any content can be placed on the flywheel in a manner such that it can be replaced.

Regarding a particularly safe and comfortable handling of the barbell, in particular a dumbbell, it is advantageous when the handle formed by the dumbbell bar, or the grip surrounding the dumbbell bar, e.g. in the form of a tube, can rotate. This requires a low-friction bearing, a friction-bearing in the simplest case.

In accordance with the above explanations, the weight plates belonging to the dumbbell can be handled independently of the complete dumbbell, wherein dumbbell bars that are commercially available have a standardized diameter for receiving standard commercial weight plates. It is thus conceivable to refit weight plates or equip dumbbells with a self-adjusting flywheel corresponding to that described above.

There are various possibilities for advantageously embodying and developing the teachings of the present invention. Reference is made in this regard to the claims dependent on claim 1, and to the following explanations of an exemplary embodiment of the invention based on the drawings. Generally preferred designs and developments of the teachings are also explained in conjunction with the explanations of the preferred exemplary embodiment based on the drawings. Therein:

Figure 1:
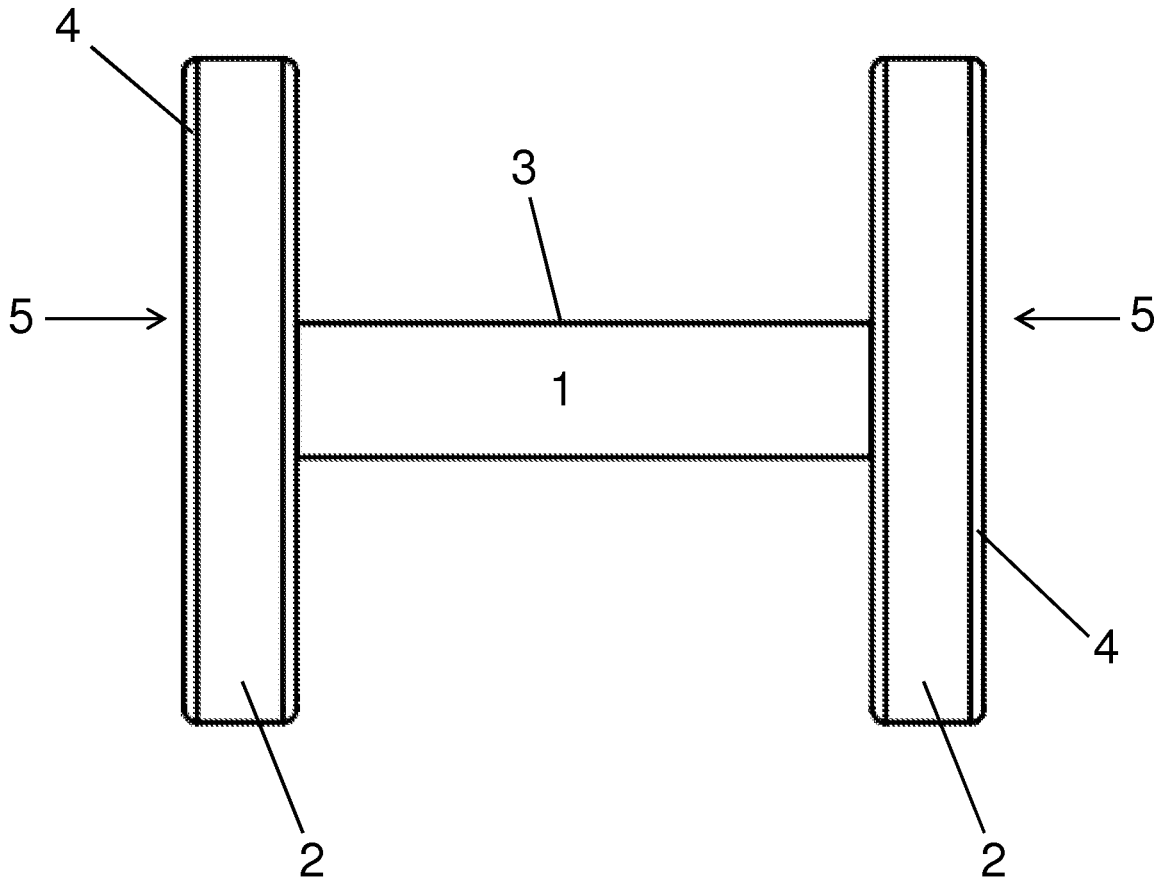
FIG. 1 shows a front view of an exemplary embodiment of a barbell according to the invention in the form of a dumbbell.

FIG. 1 shows a schematic front view of a barbell according to the invention, in the form of a dumbbell. The dumbbell comprises a dumbbell bar 1 functioning as a handle and two weight plates 2 at the ends thereof. The handle 3 formed by the dumbbell bar 1 can be non-rotatable with respect to the two weight plates 2, or it can rotate in relation thereto. With a rotating design of the handle 3, it is possible for this to be a rotating sleeve that is mounted on the dumbbell bar 1 such that it can rotate thereon.

A slightly protruding rim 4 is indicated in FIG. 1, which extends slightly beyond or above the lateral surfaces 5 of the weight plates 2.

Figure 2:
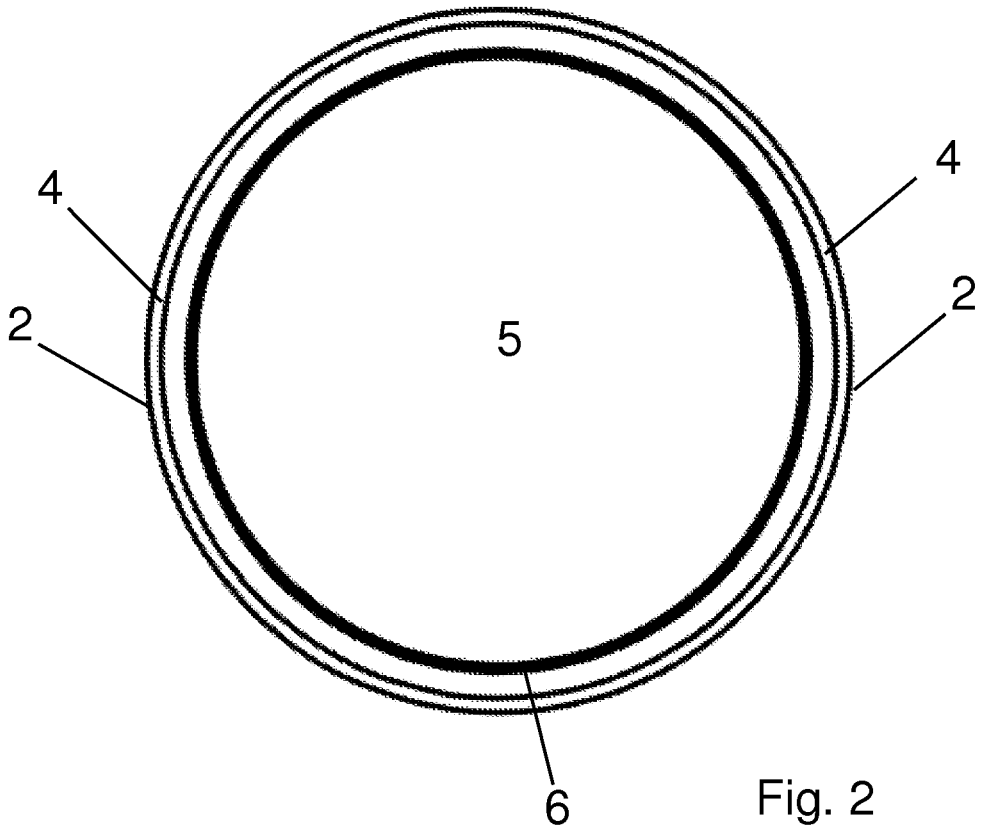
FIG. 2 shows a schematic side view of the dumbbell in FIG. 1.

FIG. 2 shows the dumbbell in FIG. 1 from the side, i.e. in a perspective looking directly at the lateral surface 5 of the weight plate 2, wherein this surface is formed by a flywheel 6. This is subjected to gravity according to the invention, and always aligns itself in the same angular position, such that a correctly applied labeling is always correctly aligned.

Figure 3:
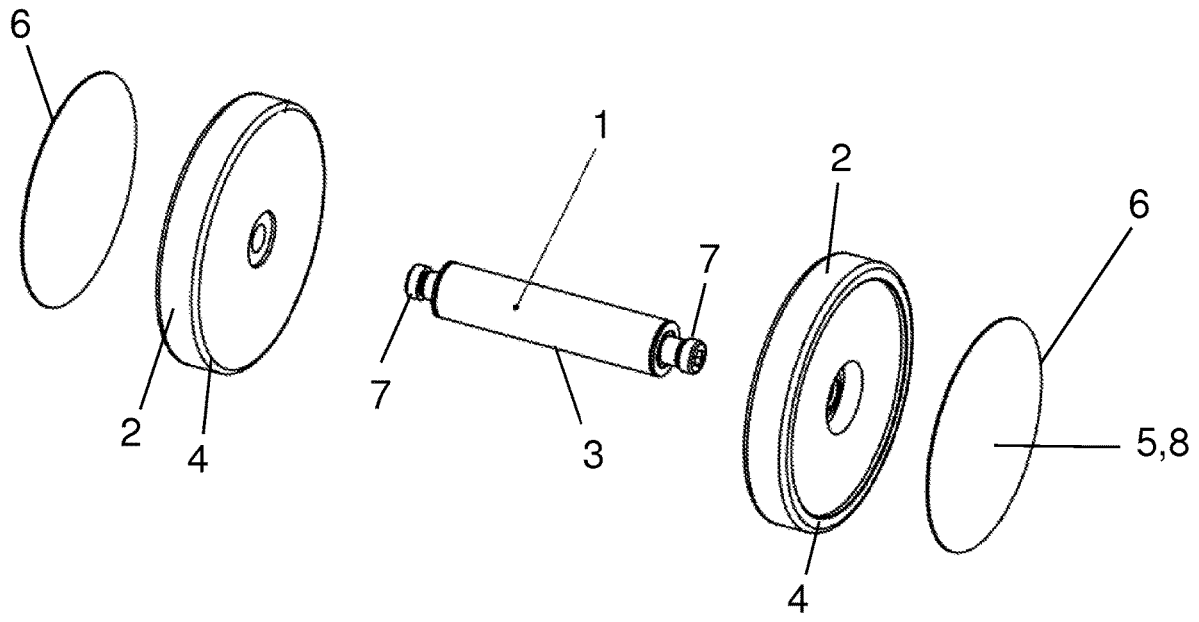
FIG. 3 shows a schematic exploded view of the individual components of the dumbbell according to the invention, in accordance with FIGS. 1 and 2.

FIG. 3 shows an exploded view of the dumbbell according to the invention, broken down into its individual components.

The bar 1 is shown in the middle, wherein the handle 3 is formed by a sleeve encompassing the dumbbell bar 1. Attachment means 7 are indicated at both ends of the dumbbell bar 1, which are used for a removable attachment of the weight plates 2. As a result, the dumbbell can be assembled as such.

Recesses or receiving spaces are formed on the outer surfaces of both weight plates 2, specifically through the provision of the rim 4. Flywheels 6 can thus be placed on both sides, wherein the attachment means necessary for this, in particular a suitable bearing of the flywheel 6 in or on the weight plate 2, is not shown for reasons of simplicity. The provision of various receiving spaces with ball bearings, in concrete terms the provision of a bearing journal on the inner surface of the flywheel, which engages with a ball bearing inside the weight plate 2, or on the attachment means 7 of the bar 1, is conceivable.

At this point it should be noted that the concrete securing or retaining, or bearing of the weighted flywheel 6 is not important, as long as it is ensured that the flywheel 6 can align itself in accordance with its asymmetrical weighting, such that the outer surface 8 of the flywheel 6 can always be correctly read or viewed.

Regarding further advantageous designs of the piece of equipment according to the invention, reference is made to the general portion of the description and to the attached claims, in order to avoid repetition.

Lastly, it should be expressly noted that the exemplary embodiment of the piece of equipment according to the invention described above serves only for explaining the invention, which is not, however, limited to the exemplary embodiment.

LIST OF REFERENCE SYMBOLS

1 dumbbell bar
2 weight plate
3 handle
4 rim (of the weight plate)
5 lateral surface, outer surface (of the weight plate)
6 flywheel
7 attachment means (both ends of the bar)
8 outer surface of the flywheel

The invention claimed is:

1. A dumbbell with a dumbbell bar functioning as a handle, and weight plates on ends, which can be placed or slid onto the dumbbell bar, and can be exchanged with different weights, wherein the weight plates have an outer surface that faces outward when placed on the bar, characterized in that the outer surface is formed by an asymmetrically weighted flywheel, which is mounted on the weight plates, parallel thereto, such that the flywheel can rotate about a central axis, such that the flywheel always assumes the same orientation or angular position.

2. The dumbbell according to claim 1, characterized in that the weight plates have a circumferential rim extending orthogonally away from the weight plate, which at least partially extends slightly above or around the weight plate.

3. The dumbbell according to claim 2, characterized in that the rim is an integral component of the weight plate.

4. The dumbbell according to claim 2, characterized in that the rim is made of plastic or rubber.

5. The dumbbell according to claim 1, characterized in that the flywheel is flush with the rim of the weight plate.

6. The dumbbell according claim 1, characterized in that the surface of the flywheel, and thus the outer surface of the weight plate, functions as an information medium, or is suitable for attaching a flat label.

7. The dumbbell according to claim 1, characterized in that an information medium can be glued to the surface of the flywheel.

8. The dumbbell according to claim 1, characterized in that the information medium contains the weight of the weight plate and/or further information.

9. The dumbbell according to claim 1, characterized in that the grip formed by the dumbbell bar or encompassing the dumbbell bar can rotate.

10. A weight plate for a dumbbell that has a self-adjusting flywheel, which has the features according to claim 1.

* * * * *